US005154944A

United States Patent [19]

Klerken

[11] Patent Number: 5,154,944

[45] Date of Patent: Oct. 13, 1992

[54] METHOD AND APPARATUS FOR DEVELOPING A LATENT MAGNETIC IMAGE

[75] Inventor: Pierre A. M. Klerken, Venlo, Netherlands

[73] Assignee: Oce-Nederland B.V., Venlo, Netherlands

[21] Appl. No.: 789,325

[22] Filed: Nov. 8, 1991

[30] Foreign Application Priority Data

Nov. 12, 1990 [NL] Netherlands ..... 9002462

[51] Int. Cl.[5] ..... B05D 3/14

[52] U.S. Cl. ..... 427/598; 118/653; 118/658; 355/246; 355/251; 355/261; 427/457; 427/128; 427/145; 427/197; 427/256; 430/39; 430/102; 430/103; 430/122

[58] Field of Search ..... 427/12, 47, 256, 128, 427/145, 197; 118/653, 658; 355/246, 251, 261; 430/39, 102, 103, 122

[56] References Cited

U.S. PATENT DOCUMENTS 4,368,687 1/1983 Kanbe et al. ..... 118/653
4,686,933 8/1987 Fujimura et al. ..... 118/623

FOREIGN PATENT DOCUMENTS 0212669 3/1987 European Pat. Off. .
1406983 9/1975 United Kingdom .

*Primary Examiner*—Bernard Pianalto
*Attorney, Agent, or Firm*—Birch, Stewart, Kolasch & Birch

[57] ABSTRACT

A method and apparatus for developing a latent magnetic image in which a layer of magnetically attractable toner powder having a specific resistance less than $10^9$ ohms.meter is conveyed by a toner conveyor to a developing zone past a medium carrying the latent image and an AC voltage is applied between the toner conveyor and the medium carrying the latent image.

11 Claims, 1 Drawing Sheet

METHOD AND APPARATUS FOR DEVELOPING A LATENT MAGNETIC IMAGE

BACKGROUND OF THE INVENTION

1. Field of the Invention

The present invention relates to an imaging system and more specifically to a method and apparatus of developing a latent magnetic image.

2. Discussion of Related Art

U.S. Pat. No. 4,368,687 describes a method and apparatus for developing a latent magnetic image, in which a uniform, very thin layer of an electrostatically charged insulating and magnetically attractable toner powder is applied to a toner conveyor and the thin layer of toner powder is fed to a developing zone where it is brought to a distance of 200 to 400 micrometers from the image-carrying medium. To complete the image development, an AC voltage is applied in the developing zone between the toner conveyor and the image-carrying medium.

In comparison with other known developing methods in which magnetically attractable toner powder is brought into (frictional) contact with an image-carrying medium in a developing zone, the method according to the instant U.S. patent has the advantage that background resulting from the deposition of toner particles on the image-free parts of the medium is prevented. A disadvantage of this method, however, is that the apparatus for performing the method must satisfy high accuracy requirements to achieve the required slit width such that the apparatus parameters must be strictly adhered to. In addition, thin toner layers have to be used in this method so that during the development of images with high information density, such as large black areas, the disadvantage may arise such that the toner supply in the developing zone may be too low and the developed images consequently have an inadequate density.

SUMMARY OF THE INVENTION

Therefore, it is an object to the present invention to provide a method and apparatus for developing a latent magnetic image which will overcome the above-noted disadvantages.

It is another object of this invention to provide a method whereby good-quality images are obtained performed with an apparatus which does not have to meet rigorous tolerance requirements.

A further object of the present invention is to provide a latent magnetic imaging process which has a broad range of tolerances.

The foregoing objects and others are accomplished in accordance with the present invention, generally speaking, by providing a layer of a magnetically attractable toner powder on a toner conveyor which feeds the toner powder to a developing zone past a medium carrying a latent magnetic image. An AC voltage is applied between the toner conveyor and the latent image-carrying medium so as to selectively develop the latent magnetic image. Characteristic of the present invention is that the magnetically attractable toner powder used has a specific electrical resistance of less than $10^9$ ohms.meter.

The present invention also provides a magnetic printing apparatus for performing the method herein defined comprising a magnetizable image recording medium, means for recording a latent image on the image recording medium, a toner conveyor to convey magnetically attractable toner powder past the image recording medium in a developing zone, a metering device for metering a layer of magnetically attractable toner powder on the toner conveyor, and means for generating an AC voltage in the developing zone between the toner conveyor and the image recording medium. The magnetographic apparatus is characterized in that in the developing zone the shortest distance "A" in mm between the toner conveyor and the surface of the image-recording medium is determined to be between $$B+0.6<A<B+1.6$$

where "B" is the distance in mm between the metering device and the surface of the toner conveyor.

In the method according to the instant invention, very good quality images are obtained which are free of background. Magnetic images depicted on the image-recording medium with a high resolution of, for example, 400 dpi (dots per inch) are developed free of background, while one-pixel lines and loose image pixels can still being distinguishly reproduced. This good image quality is achieved not only at a relatively low speed of advancement of the image-recording medium, but also at a high speed of advancement of 30 meters per minute, equivalent to a printing speed of more than 100 pages of A4 paper per minute. An important advantage of the method according to the present invention is that there is a wide working range even when developing high resolution images and at high speeds of advancement of the image-recording medium, so that the developing apparatus is not required to satisfy high accuracy requirements. In the method according to the present invention, it is possible to form on the toner conveyor a layer of toner powder which is considerably thicker than the layer thickness indicated in the above-mentioned U.S. Pat. No. 4,368,687.

An additional advantage of the method according to the present invention is that the toner powder does not have to be electrostatically charge prior to the image development, thus obviating quality variations resulting from irregularities in the charging of the toner powder. As is already known, the electrostatic and, in particular, the tribo-electric charging of a toner powder is influenced by varying ambient conditions of temperature and humidity.

The method according to the present invention uses a magnetically attractable toner powder having a specific electric resistance of less than $10^9$ ohms.meter. The toner powder comprises resin particles in which magnetically attractable material is finely distributed. The magnetically attractable material may be soft or remanent magnetic and can be selected from those materials known per se for use in toner powders. Typical such magnetically attractable material includes iron, carbonyl iron, nickel, chromium dioxide, gammaferrioxide and ferrites of the formula $MFe_2O_4$ in which M represents a bivalent metal e.g. iron, manganese, nickel, or cobalt or a mixture of metals of other valency. Other examples are the rare-earth iron garnets of the formula $R_3Fe_5O_{12}$ in which R denotes a rare-earth or other trivalent ion e.g. Y or Sc. The iron in these garnets can be partially replaced by another ion or ions. The magnetically attractable material content is of the order of magnitude conventional for toner powders and is, for example, 6-20% by volume for soft magnetic material and 1-10% by volume for remanent magnetic material.

In addition to magnetically attractable material the resin particles contain electrically conductive material to give the toner powder a specific electric resistance of less than $10^9$ ohms.meter. The electrically conductive material which, for example, may consist of fine carbon particles or metal particles, such as silver or copper particles, may be finely distributed in the resin particles or deposited on the surface of the resin particles in a quantity sufficient to render the toner powder the required specific resistance of below $10^9$ ohms.meter. Preferably, the electrically conductive material is deposited on the surface of resin particles. Suitable toner powders for use in the method according to the present invention are described, inter alia, in Netherlands Patent Application 7203523. Representative examples of such toner powder include powders of which the individual particles consist of a magnetically attractable core composed of about 50 to 95% by weight of thermoplastic resin binder and about 5 to 50% by weight of magnetizable material which is finely distributed in the resin binder, and, adhered to the surface of the core and/or partially embedded therein, a finely divided conductive material, such as fine carbon particles, in an amount sufficient to impart the desired conductivity to the particles.

The resin binder may be a resin well-known in the art of toner powder manufacture, such as epoxy resin, polyester resin, in particular the polyester resins derived from bisphenol A or an oxyalkylated derivative thereof and a dicarboxylic acid such as maleic or fumaric acid, polystyrene, polyacrylics and polyvinylcyhloride.

The specific resistance of the toner powder is measured as follows. A cylindrical container having an inside diameter of 17.2 mm, a base which consists of brass having a thickness of 1.5 mm, and a wall which consists of Teflon having an internal height of 22.9 mm, and a thickness of 9 mm, is filled with an excess of powder. The filling is then compressed by crushing it ten times in a crusher made by Engelsmann A.G., of Ludwigshaven, Germany. This filling procedure is repeated twice. Excess powder is then wiped off with a ruler and a brass lid having a diameter of 17.2 mm and a mass of 55 g is placed on the column of powder. The filled container is placed in a Faraday cage and a 10 volt D.C. is applied between the base and lid. The current intensity is measured after about 20 seconds. The measuring procedure (container filling and current measurement) is repeated three times, whereafter the average current intensity of the three measurements is calculated.

The resistance of the powder follows from the formula:

$$p = \frac{U}{Ig} \times \frac{A'}{h}$$

where:

U=the applied voltage (10 volts)

A'=contact area of lid and powder column ($2.32\times10^{-4}m^2$)

h=height of powder column ($2.29\times10^{-2}m$)

Ig=average current strength (in amps).

The specific resistance of the toner powder should be less than $10^9$ ohms.meter. No critical bottom limit has been found for the resistance. Thus good image development was obtained even with toner powder having a specific resistance of $10^3$ to $10^4$ ohms.meter, which also was found to provide a wide working range.

BRIEF DESCRIPTION OF THE DRAWINGS

The invention and its advantages are now explained in greater detail with reference to FIG. 1 which diagrammatically illustrates a magnetic printing apparatus in which the method according to the instant invention is used.

DETAILED DISCUSSION OF THE INVENTION

Figure 1:
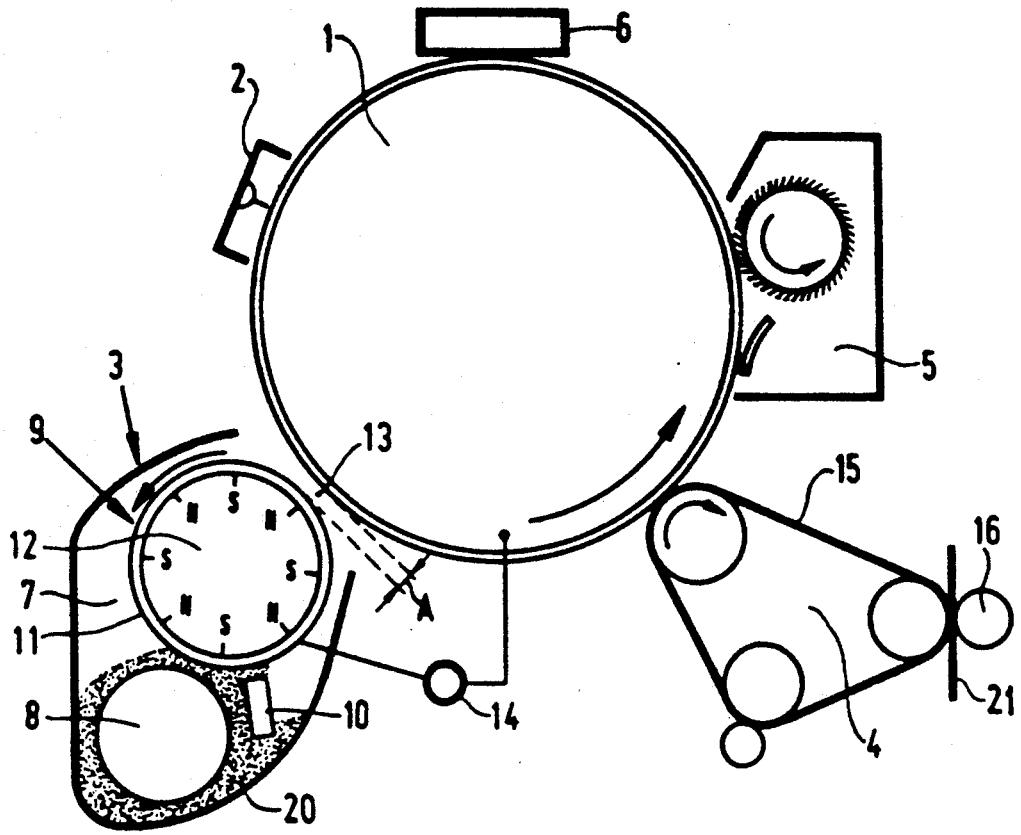

The apparatus according to the present invention comprises a cylindrical image recording medium 1 consisting of a drum of copper or copper-plated aluminum, the surface of which is covered with a galvanically applied cobalt-nickel phosphorus layer about 8 micrometers thick, which has a magnetic coercivity of about 77 kA/m. The image-recording medium 1 can rotate in the direction indicated by the arrow. Disposed consecutively along the rotational path of the image recording medium 1, as considered in the direction of rotation there is a magnetic head array 2, with which a latent magnetic image having a resolution of about 400 dpi can be recorded in the magnetizable layer, a developing device 3, an image transfer device 4, a cleaning device 5, and an erase device 6. The magnetic head array 2 is of the type described in detail in European Patent Application 87200230. The developing device 3 comprises a reservoir 7 for the toner powder 20, a powder supply roller 8 having a rough surface, a toner conveyor 9 which feeds the toner powder 20 into the developing zone 13, and a metering device 10. The powder supply roller 8 feeds the toner powder to the toner conveyor 9. The latter consists of a magnetic roller having a rotatable electrically conductive non-magnetizable sleeve 11 of, for example, copper and a stationary magnet system 12 inside the sleeve 11. In the embodiment illustrated, the magnet system 12 comprises eight magnet poles magnetized as shown in the drawing. The magnet pole situated opposite the image-recording medium 1 generates a magnetic induction of, for example, about 225 gauss at the surface of sleeve 11 immediately thereabove, while the other magnet poles generate an induction of 800 gauss at the surface of the sleeve. The lower magnetic induction in the developing zone 13 is of no essential importance to obtaining good image development. All that is important is that there should not be such a magnetic field in the developing zone 13 which creates an erasing effect on the latent magnetic image on the image-recording medium 1. The method according to the present invention can also be performed using a toner conveyor so constructed that no magnetic field, or only a very weak magnetic field, is present in the developing zone 13. Embodiments of such toner conveyors are indicated in U.S. Pat. No. 4, 368,687 mentioned above.

The distance between the sleeve 11 and the image-recording medium 1 can be varied by moving the toner conveyor 9. The distance between sleeve 11 and the metering device 10, which consists of aluminum for example and is in the form of a ruler, is adjustable. The distance "B" as discussed above, denotes the shortest distance between the sleeve 11 and the metering device 10.

The electrically conductive sleeves of the toner conveyor 9 and the image-recording medium 1, respectively, are connected to an AC supply 14.

A powder image developed on the image-recording medium 1 is transferred to an image-receiving material 21 by the transfer device 4. The latter is a two-step transfer device known per se, in which the powder image of the image-recording medium 1 is first transferred, by pressure, to a belt 15 bearing a silicone rubber surface covering. The belt 15 is heated by heating means (not shown) to soften the powder image transferred thereto. In a pressure zone formed between the belt 15 and a biasing roller 16 the softened powder image is then transferred to and fixed o the receiving material 21 fed to the pressure zone from a supply (not shown).

EXAMPLES

The working range of the developing device of the instant illustration is determined by using a toner powder having a resistance of about $3.5\times10^5$ ohms.meters, a particle size of between 10 and 20 micrometers, and particles containing 20% by volume of a soft magnetic pigment (type Bayferrox B 318 M made by Bayer AG, Germany) and 80% by volume of a polyester resin, the surface being covered with carbon particles. Background-free images of good quality are obtained with the following settings:

Speed of rotation of sleeve 11: 25 to 45 meters per minute;

Distance "B" between sleeve 11 and metering device 10: 0.6–2 mm;

AC voltage of 500–2000 V; and frequency 900–2400 Hz.

Primarily dependent on the value of the applied AC voltage, the optimal value for the distance A (distance between sleeve 11 and image-recording medium 1) was found to be between the distance B plus 0.6 to 1.6 mm. In the low area of the AC voltage range (500 to about 900 V), the difference between distance A and distance B (hereinafter indicated by delta w) was in the range from 0.6–1 mm, and gradually shifted to higher values with increasing AC voltage. The delta w appeared to have a working range of some tenths of a millimeter for each applied Ac voltage. With AC voltages of from about 1200 V to about 600 V this working range was determined to be 0.3 to 0.4 mm. With a distance B of about 1.3 mm, an AC voltage of about 1500 V and a frequency of 1800 Hz, the value of delta w, given a speed of rotation of sleeve 11 between 25 and 45 meters per minute and a speed of advance of the image-recording medium 1 of from 15 to 40 meters per minute, was found to be between about 0.9 to 1.3 mm.

In a subsequent test series, the resistance of the toner powder used varied between about $10^3$ and $10^9$ ohms.meter with the above settings being distance B: 1.3 mm; AC voltage 1500 V, 1800 Hz; speed of rotation of sleeve 11: 45 meters per minute; and speed of rotation of image-recording medium 1: 15 meters per minute. Good quality prints are obtained in every case with delta w values between 0.9 and 1.3 mm. The quality of the images obtained with the toner powder having a specific resistance of more than $10^8$ ohms.meter is a fraction less satisfactory than that of the images obtained with the other toner powders. The toner powders used in these tests consisted of particles containing 20% by volume of soft magnetic pigment (Bayferrox B 318 M) and 80% by volume of the polyester resin, the surface being covered with fine carbon particles.

Using a toner powder in which the particles ranged in size of between 10 and 20 micrometers and consisted of 94% by volume polyester resin, 3% by volume remanent magnetic pigment (type Bayferrox 8140 made by Bayer AG, Germany) and 3% by volume carbon, and which were covered with carbon to a specific resistance of $2\times10^5$ ohms.meter, a same working range was found as described above for toner powder containing 20% by volume of the soft magnetic pigment.

In the method and apparatus according to the present invention, the distance between the toner conveyor and the surface of the image-recording medium in the developing zone can be so widely varied that toner powder 20 is deposited on the image-recording medium only when the AC voltage is applied across the developing zone. If further image development is to be avoided for some reason, e.g. in the event of a malfunction in the image transfer device or in the supply of image receiving material, immediate response is possible by switching off the AC supply. Using the method according to the present invention, a multi-color printing apparatus can be configured in a relatively simple manner of the type in which a number of developing devices, e.g. 2, 3 or 4, are disposed around the rotational path of the image-recording medium, each such developing device being filled with toner powder of a specific color and the appropriate color separation images printed in consecutive rotational cycles of the image-recording medium, the separation images being combined in register on a combining medium, e.g. the image-receiving material or an intermediate. The development of each of the separation images in the associated color is controlled by applying the AC voltage to the developing device required to be operative.

Mechanical means to move the developing devices between an operative position and an inoperative position or to cut off the toner supply to the developing devices which are not allowed to be operative are thus unnecessary, so that it is possible to embody an apparatus of simple construction.

The invention being thus described, it will be obvious that the same may be varied in many ways. Such variations are not to be regarded as a departure from the spirit and scope of the invention, and all such modifications as would be obvious to on skilled in the art are intended to be included within the scope of the following claims.

I claim:

1. A method of developing a latent magnetic image which comprises:

forming a latent magnetic image in the surface of a magnetizable image recording medium, providing a layer of a magnetically attractable toner powder on a surface of a toner conveyor, introducing said layer of magnetically attractable toner powder into a developing zone opposite said latent magnetic image, and applying an AC voltage between said toner conveyor and said image support medium so as to develop said latent magnetic image with said magnetically attractable toner powder to produce a powder image, said toner powder having an electrical resistance of less than $10^9$ ohms.meter.

2. The method according to claim 1, further including the step of providing a metering means for metering said layer of magnetically attractable toner powder to a desired thickness on the surface of said toner conveyor.

3. The method according to claim 1, wherein in said developing zone a shortest distance A in mm between said toner conveyor and said surface of said image recording medium comprises $$B+0.6<A<B+1.6$$

where B is a distance in mm between said metering device and said surface of said toner conveyor.

4. The method of claim 3, wherein said distance A is varied by moving said toner conveyor with respect to said image recording medium.

5. The method according to claim 1, wherein said toner powder comprises resin particles in which magnetically attractable material is finely distributed.

6. The method according to claim 4, wherein said toner powder further includes electrically conductive material in an amount sufficient to impart said required electrical resistance.

7. The method according to claim 1, wherein distance between said toner conveyor and the surface of said image recording medium is such that toner transfer to said image recording medium to develop said latent magnetic image takes place only when said AC voltage is applied.

8. A magnetic printing apparatus for producing a powder image comprising:

a magnetizable image recording medium;

means for recording a latent magnetic image on a surface of said image recording medium;

a toner conveyor means for conveying a magnetically attractable toner powder past said image recording medium thereby creating a developing zone between said image recording medium and said toner conveyor means for said latent magnetic image;

a metering device for metering a layer of magnetically attractable toner powder to a desired thickness on a surface of said toner conveyor; and means for generating an AC voltage in said developing zone between said toner conveyor and said image recording medium, such that a shortest distance A in mm between the surface of said toner conveyor and the surface of said image recording medium in said developing zone is between B+0.6 and B+1.6, where B is a distance in mm between said metering device and the surface of said toner conveyor.

9. The apparatus according to claim 8, wherein said toner conveyor means consists of a magnetic roller including a rotatable electrically conductive, non-magnetizable sleeve and a stationary magnet system disposed inside said sleeve.

10. The apparatus according to claim 8, wherein said means for recording a latent magnetic image on said image recording medium consists of a magnetic head array.

11. The apparatus according to claim 8, further including a transfer means for transferring said powder image from said image recording medium to an image receiving material.

* * * * *